US006622932B1

(12) United States Patent
Schmidt et al.

(10) Patent No.: US 6,622,932 B1
(45) Date of Patent: Sep. 23, 2003

(54) FUEL INJECTOR FOR AN INTERNAL COMBUSTION ENGINE

(75) Inventors: Günther Schmidt, Meckenbeuren (DE); Albert Kloos, Friedrichshafen (DE)

(73) Assignee: MTU Motoren-und Turbinen-Union Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 09/958,804

(22) PCT Filed: Apr. 13, 2000

(86) PCT No.: PCT/EP00/03319

§ 371 (c)(1),
(2), (4) Date: Oct. 16, 2001

(87) PCT Pub. No.: WO00/63550

PCT Pub. Date: Oct. 26, 2000

(30) Foreign Application Priority Data

Apr. 16, 1999 (DE) ..... 199 17 190

(51) Int. Cl.[7] ..... F02D 1/06
(52) U.S. Cl. ..... 239/5; 239/91; 239/533.3
(58) Field of Search ..... 239/88.92, 96, 239/533.3, 533.4, 533.2, 533.5, 584, 5

(56) References Cited

U.S. PATENT DOCUMENTS 5,692,683 A 12/1997 Mathis

FOREIGN PATENT DOCUMENTS

| | | |
|---|---|---|
| DE | 4332837 C1 | 7/1994 |
| EP | 582993 A1 | 2/1994 |
| EP | 639710 A1 | 2/1995 |
| EP | 844383 A2 | 5/1998 |

*Primary Examiner*—Lisa A. Douglas
(74) *Attorney, Agent, or Firm*—Crowell & Moring LLP

(57) ABSTRACT

Within an injector housing, a nozzle needle comprising a nozzle needle shaft is accommodated in a first guide boring in a longitudinally displaceable manner. A nozzle prechamber which is arranged in front of the nozzle needle shaft and which is situated on the fore-part of the first guide boring is supplied with fuel via a high pressure channel. A control valve permits a control chamber, which is coupled to the nozzle needle and which is subjected to the action of highly pressurized fuel, to be relieved from pressure by opening the nozzle needle. According to a second embodiment, a spring chamber is configured as a high-pressure chamber on the rear side of the first guide boring that guides the nozzle needle shaft. The spring chamber is separate from the control chamber and contains a readjusting spring that impinges upon the nozzle needle in a direction of closure. This configuration prevents fuel exiting the nozzle prechamber from overflowing over the guide boring which guides the nozzle needle.

45 Claims, 3 Drawing Sheets

FUEL INJECTOR FOR AN INTERNAL COMBUSTION ENGINE

BACKGROUND AND SUMMARY OF THE INVENTION

The invention relates to a fuel injector for injecting fuel provided at a high pressure into the combustion space of an internal-combustion engine.

Such a known fuel injector comprises an injector housing and a nozzle needle which has a nozzle needle shaft, which is longitudinally displaceably disposed in a first guide bore constructed in the injector housing, and a nozzle needle point interacting in the sense of an opening and closing of a valve opening cross-section with a valve seat constructed in the forward end of the injector housing. For supplying highly pressurized fuel to be injected, a high-pressure duct is provided. On the face side of the first guide bore, a nozzle antechamber is disposed in front of the nozzle needle shaft, which antechamber is acted upon at a high pressure by the fuel to be injected which is supplied by way of the high-pressure duct. A control space acted upon by highly pressurized fuel is coupled with the nozzle needle, which control space can be relieved from pressure by a control valve in the sense of an opening of the nozzle needle. At the rearward side of the first guide bore, a space is arranged which receives fuel flowing from the nozzle antechamber by way of the first guide bore.

Such a fuel injector has the disadvantage that considerable leakage occurs between the nozzle antechamber and the space arranged on the rearward side of the first guide bore as well as between the control space and this space, which leakage may be in the range of up to 20 or 30% of the maximal injection quantity.

It is an object of the invention to construct a fuel injector of the initially mentioned type such that this leakage is avoided.

This object is achieved by way of a fuel injector having the space arranged on the rearward side of the first guide bore is a high-pressure space acted upon by a highly pressurized fuel.

Advantageous further developments of the fuel injector according to the invention are characterized in the preferred embodiments.

The fuel injector according to the invention is provided for injecting highly pressurized fuel into the combustion space of an internal-combustion engine. The fuel injector comprises an injector housing and a nozzle needle which has a nozzle needle shaft, which is longitudinally displaceably disposed in a first guide bore constructed in the injector housing, and a nozzle needle point interacting in the sense of an opening and closing of a valve opening cross-section with a valve seat constructed in the forward end of the injector housing. For supplying highly pressurized fuel to be injected, a high-pressure duct is used. On the face side of the first guide bore, a nozzle antechamber is disposed in front of the nozzle needle shaft, which antechamber is acted upon at a high pressure by the fuel to be injected which is supplied by the high-pressure duct. A control space acted upon by highly pressurized fuel is coupled with the nozzle needle, which control space can be relieved from pressure by a control valve in the sense of an opening of the nozzle needle. At the rearward side of the first guide bore, a space is arranged which receives fuel flowing from the nozzle antechamber by way of the first guide bore or from the control space. According to the invention, the space arranged on the rearward side of the first guide bore is a high-pressure space acted upon by a highly pressurized fuel.

The significant advantage of the fuel injector according to the invention is the fact that no space which is at a low pressure level is situated on the rearward side of the first guide bore guiding the nozzle needle, so that no leakage can occur by way of this space.

According to an aspect of the invention, the high-pressure space constructed on the rearward side of the first guide bore is formed by the control space. This results in the advantage that, as a result of the pressure existing in the control space, a flowing over of fuel by way of the first guide bore is not possible. Another advantage is the fact that, because of the direct action upon the nozzle needle by the pressure situated in the control space, a very rapid response behavior of the fuel injector is achieved. Since there is no low-pressure space adjoining the control space, a leakage from the control space cannot take place.

According to a further development of the invention, the control space forming the rearward-side high-pressure space contains a restoring spring acting upon the nozzle needle in the closing direction.

The restoring spring is advantageously formed by a cup spring arrangement. Preferably, it is provided that the restoring spring is supported on one end by a first abutment provided on the rearward side of the nozzle needle shaft and is supported on the other end by a second abutment constructed on the rearward side of the control space.

According to an advantageous embodiment of the invention, the control space forming the rearward-side high-pressure space is formed by a bore extending in the longitudinal direction of the injector housing and, on its rearward side, is bounded by a valve body of the control valve inserted into this bore.

The control space forming the rearward-side high-pressure space is preferably connected by way of a throttle duct with the high-pressure duct carrying the fuel to be injected.

According to a second aspect of the invention, the rearward high-pressure space is formed by a spring space containing the restoring spring acting upon the nozzle needle in the closing direction. In this respect, it is advantageous that the restoring spring can be optimally dimensioned, while simultaneously the control space can be constructed to be very small, which is advantageous for the response behavior of the fuel injector.

The spring space is preferably connected by way of a fluidic connection with the high-pressure duct carrying the fuel to be injected.

According to a particularly advantageous embodiment of this variant of the fuel injector according to the invention, a second guide bore is constructed at the rearward side of the spring space forming the high-pressure space, which second guide bore extends coaxially to the first guide bore carrying the nozzle needle shaft and in which a guiding piston is displaceably in the longitudinal direction disposed, which guiding piston is coupled by way of a needle stilt with the nozzle needle, the guiding piston bounding the spring space on its rearward side.

The control space is preferably constructed on the rearward side of the guiding piston, in which case the fuel which is present at a high pressure in the spring space and the restoring spring act upon the nozzle needle shaft in the sense of a closing of the nozzle needle and, when the control space is relieved from pressure, the nozzle needle is relieved by the control valve by the guiding piston in the sense of an opening.

The first guiding bore guiding the nozzle needle shaft preferably has a diameter D1. The spring space is formed by a third bore coaxial to the first guide bore, the diameter D2 of the third bore being larger than the diameter D1 of the first guide bore. The control space is formed by the second guide bore with a diameter D1' which is coaxial to the first guide bore and the spring space.

According to a preferred embodiment, it is provided that the diameters D1, D1' and D2 are mutually coordinated such that the needle stilt during the opening as well as during the closing of the nozzle needle is only stressed with respect to tension. As a result, a buckling or a one-sided contact of the nozzle needle stilt, which could result in a jamming, will be avoided.

According to a preferred embodiment, the first guide bore and the second guide bore have the same diameter D1. The resulting advantage is a simplification during the manufacturing of the fuel injector.

According to a preferred embodiment, the restoring spring is supported on one end by a first abutment provided on the rearward side of the nozzle needle shaft and is supported on the other end by a second abutment constructed on the rearward side of the spring space.

The control space preferably has a significantly smaller volume than the spring space.

According to an advantageous further development of the fuel injector according to the invention, it is provided that the injector housing contains on the rearward-side end an individual storage device for supplying highly pressurized fuel, which individual storage device is connected with the high-pressure duct carrying the fuel to be injected. Such an individual storage device can be implemented particularly in the case of the fuel injector according to the first embodiment of the invention, in which the rearward-side high-pressure space is formed by the control space because a significant amount of length is saved in this embodiment and can be utilized for the individual storage device.

Other objects, advantages and novel features of the present invention will become apparent from the following detailed description of the invention when considered in conjunction with the accompanying drawings.

DETAILED DESCRIPTION OF THE DRAWINGS

Figure 1:
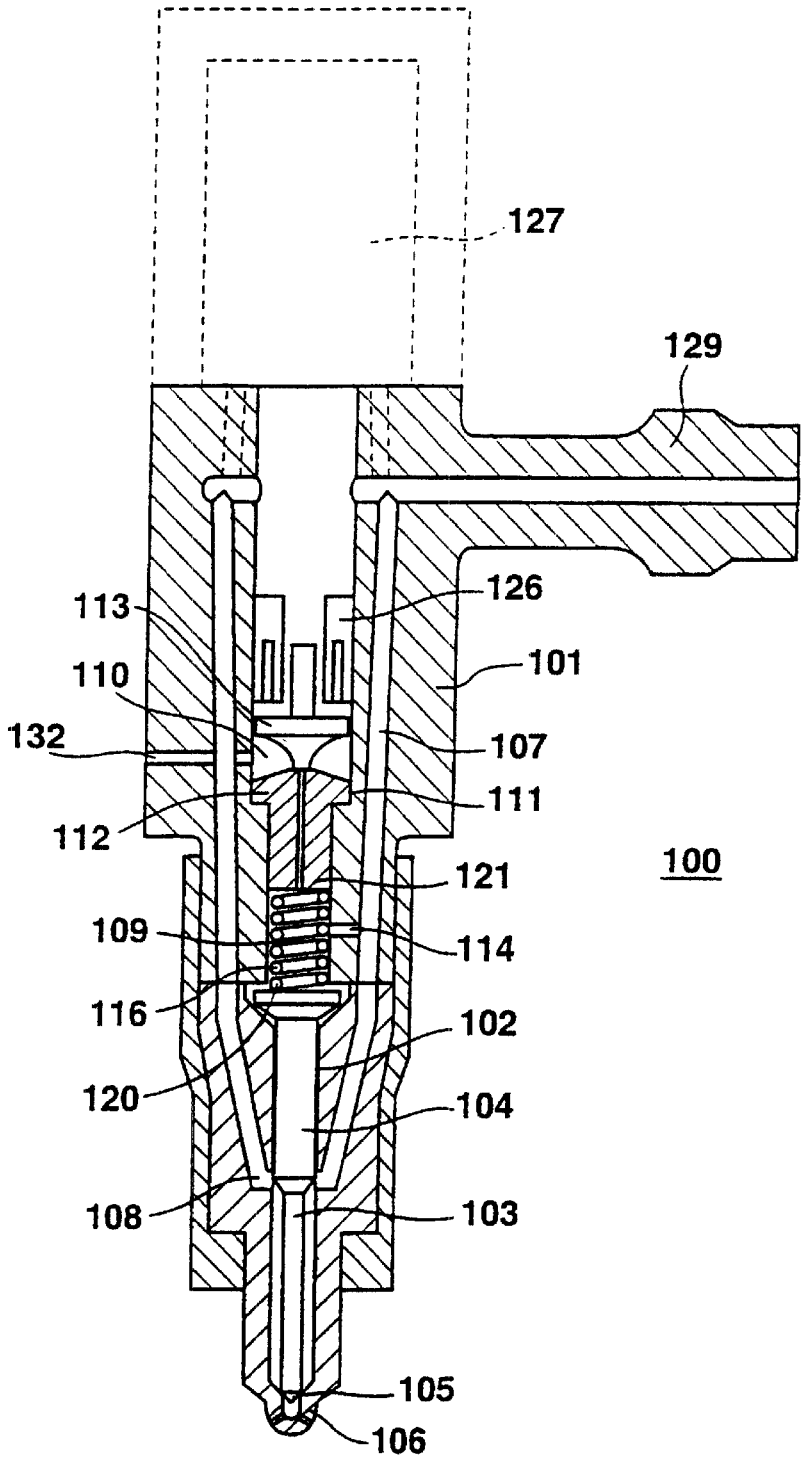
FIG. 1 shows a slightly schematic longitudinal sectional view of a fuel injector according to a first embodiment of the invention having the control space.

First, by way of FIG. 3, a fuel injector will be described for injecting highly pressurized fuel into the combustion space of an internal-combustion engine, as known according to the state of the art. The fuel injector, which as a whole has the reference number 300, comprises an injector housing 301, in which a nozzle needle 303 with a nozzle needle shaft 304 is longitudinally displaceably disposed in a first guide bore 302 constructed in the injector housing 301. The nozzle needle 303 has a nozzle needle point 305 which interacts in the sense of an opening and closing of a valve opening cross-section with a valve seat 306 constructed in the forward end of the injector housing 301, the valve opening cross-section being provided between the needle point 305 and the valve seat 306. A high-pressure duct 307 is provided for feeding highly pressurized fuel to be injected which is supplied by way of a pressure connection 329. The fuel is held at a high pressure in an oil-elastic pressure storage device (common rail), into which it is supplied by way of a high-pressure pump from a fuel supply (not shown in the figure).

On the front face of the first guide bore 302, a nozzle antechamber 308 is disposed in front of the nozzle needle shaft 304 and provided in the injector housing 301, which nozzle antechamber 308 is acted upon by the highly pressurized fuel to be injected which is supplied by way of the high-pressure duct 307. A control space 309 which by way of a throttle duct 314 connected with the high-pressure duct 307 is acted upon by highly pressurized fuel, is, by way of a needle stilt 322, which is displaceably in the longitudinal direction of the fuel injector 300 in a guiding sleeve 330 arranged in the injector housing 301, coupled with the nozzle needle 303. On the rearward side of the control space 309, a control valve 310 is provided which is formed by a valve body 312 and a closing body 313.

With respect to its operation, the closing body 313 of the control valve 310 is coupled with a solenoid 326, by which the control valve 310 is opened and closed. When the control valve 310 is closed, the nozzle needle 303 is kept closed by way of the needle stilt 322 by the high pressure present in the control space 309. While during the opening of the control valve 310, the control space 309 can be relieved from pressure in the sense of an opening of the nozzle needle 303 by way of the needle stilt 322.

On the rearward side of the first guide bore 302 guiding the nozzle needle 303, a low-pressure space 331 is constructed partially surrounding the needle stilt 322 between the nozzle needle 303 and the control space 309. By way of this low-pressure space 331, fuel flowing over from the nozzle antechamber 308 by way of the first guide bore 302 and from the control space 309 by way of the guide sleeve 330 is discharged as a leakage quantity. Surrounding the forward end of the needle stilt 322, a restoring spring 316 for closing the nozzle needle 303 is provided in the low-pressure space 331 between a first abutment 320 provided on the rearward side of the nozzle needle 303 and a second abutment 321 provided on the injector housing 301.

When the control space 309 is relieved from pressure, the nozzle needle 303 is opened by way of the control valve 310 by the fuel pressure applied in the nozzle antechamber 308 to the nozzle needle shaft 304. The fuel quantity closing off by way of the control valve 310 when the control space 309 is relieved from pressure, is discharged jointly with the fuel quantity from the low-pressure space 331 by way of a leakage duct 332.

A first embodiment of a fuel injector according to the invention for injecting highly pressurized fuel into the combustion space of an internal-combustion engine will now be described by way of FIG. 1. Similar to the known fuel injector, in the case of the fuel injector illustrated here and marked with the reference number 100 in an injector housing 101, a nozzle needle 103 is longitudinally displaceably disposed with a nozzle needle shaft 104 in a first guide bore 102 constructed in the injector housing 101. On its forward end, the nozzle needle 103 has a nozzle needle point 105 which interacts in the sense of an opening and closing of a valve opening cross-section with a valve seat 106 constructed in the forward end of the injector housing 101, which valve opening cross-section is provided between the nozzle needle point 105 and the valve seat 106. For feeding highly pressurized fuel to be injected, a high-pressure duct 107 is constructed in the injector housing 101. The fuel to be injected is supplied by way of a pressure connection 129 by an oil-elastic storage device (common rail) to which the fuel is delivered from a fuel supply by way of a high-pressure pump (not shown).

On the forward side of the first guide bore 102, a nozzle antechamber 108 is disposed in front of the nozzle needle shaft 104, which nozzle antechamber 108 is acted upon by highly pressurized fuel to be injected which is supplied by way of the high-pressure duct 107. On the rearward side of the nozzle needle 103, a control space 109 is constructed in the injector housing 101 and adjoins the first guide bore 102 and by way of a throttle duct 114 connected with the high-pressure duct 107 is acted upon by highly pressurized fuel. The control space 109 is formed by a control space bore 111 in the injector housing 101 and is bounded on its rearward side by a valve body 112 of a control valve 110 inserted into the control space bore 111. With respect to the operation, a closing body 113 of the control valve 110 is coupled with a solenoid 126 provided in the rearward end of the injector housing 101. Furthermore, a restoring spring 116 is arranged in the control space 109, which restoring spring 116 is supported between a first abutment 120 provided on the rearward side of the nozzle needle shaft 104 and a second abutment 121 formed by the forward side of the valve body 112 of the control valve 110.

When the control valve 110 is closed, the nozzle needle 103 is kept closed under the effect of the restoring spring 116 and of the highly pressurized fuel in the control space 109. When the control space 109 is relieved from pressure by way of the control valve 110, the nozzle needle 103 is opened under the effect of the highly pressurized fuel present in the nozzle antechamber 108, in which case the fuel flowing off from the control space 109 by way of the control valve 110 is discharged by way of the leakage duct 132.

The injector housing 101 may contain on the rearward side end an individual storage device 127 for supplying highly pressurized fuel. The individual storage device 127 can connect to the high-pressure duct 107.

Figure 3:
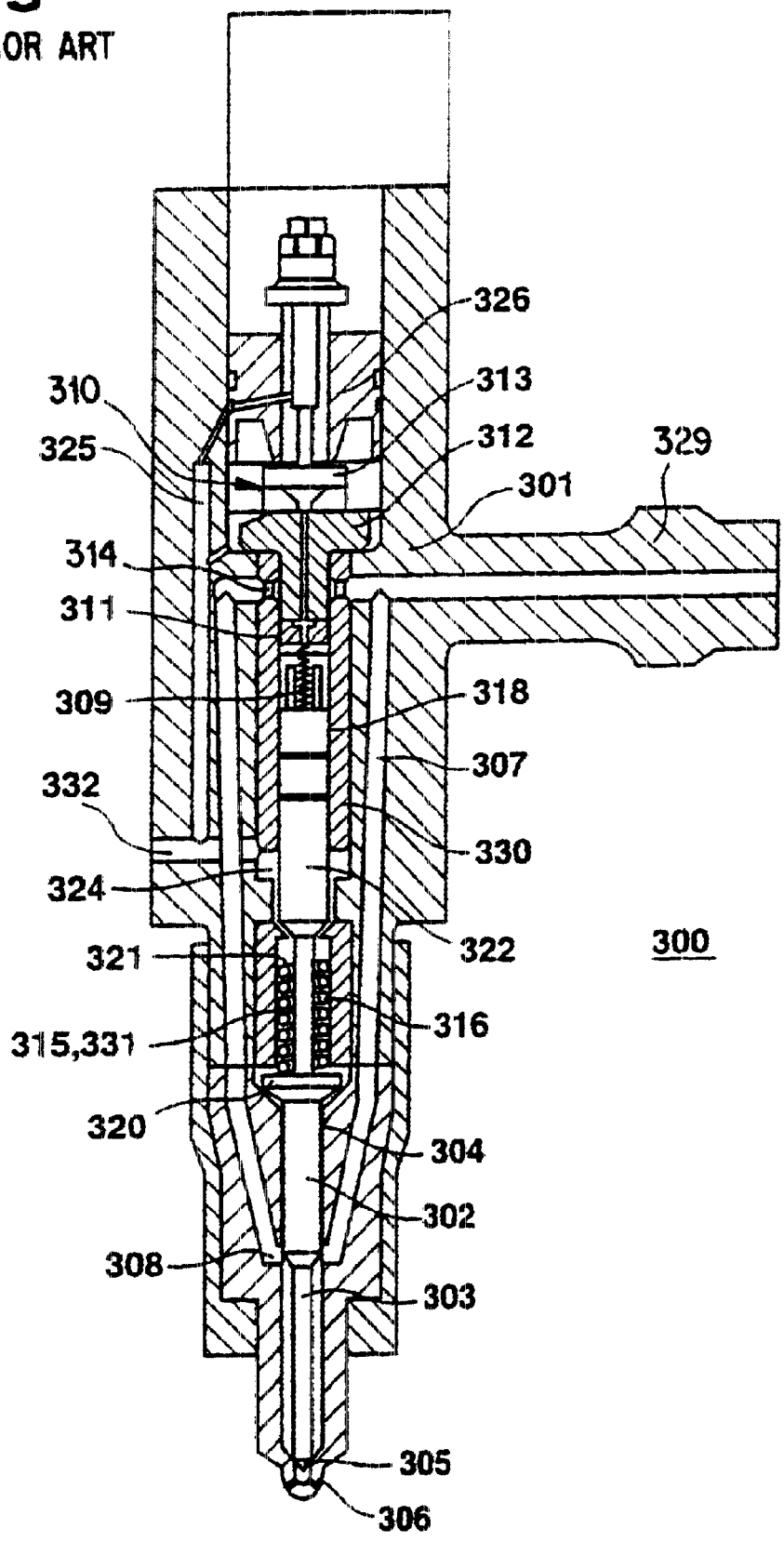
Fig. 3 PRIOR ART
FIG. 3 shows a slightly schematic longitudinal sectional view of a fuel injector according to the state of the art.

As shown by a comparison with the fuel injector according to the prior art illustrated in FIG. 3, no low-pressure space is situated on the rearward side of the nozzle needle 103, by way of which low-pressure space a leakage quantity could occur which flows over from the nozzle antechamber 108 through the first guide bore 102. The highly pressurized fuel present in the control space 109 prevents such a flowing-over of fuel from the nozzle antechamber 108 by way of the first guide bore 102. In the illustrated embodiment, the restoring spring 116 is formed by a cup spring arrangement.

Figure 2:
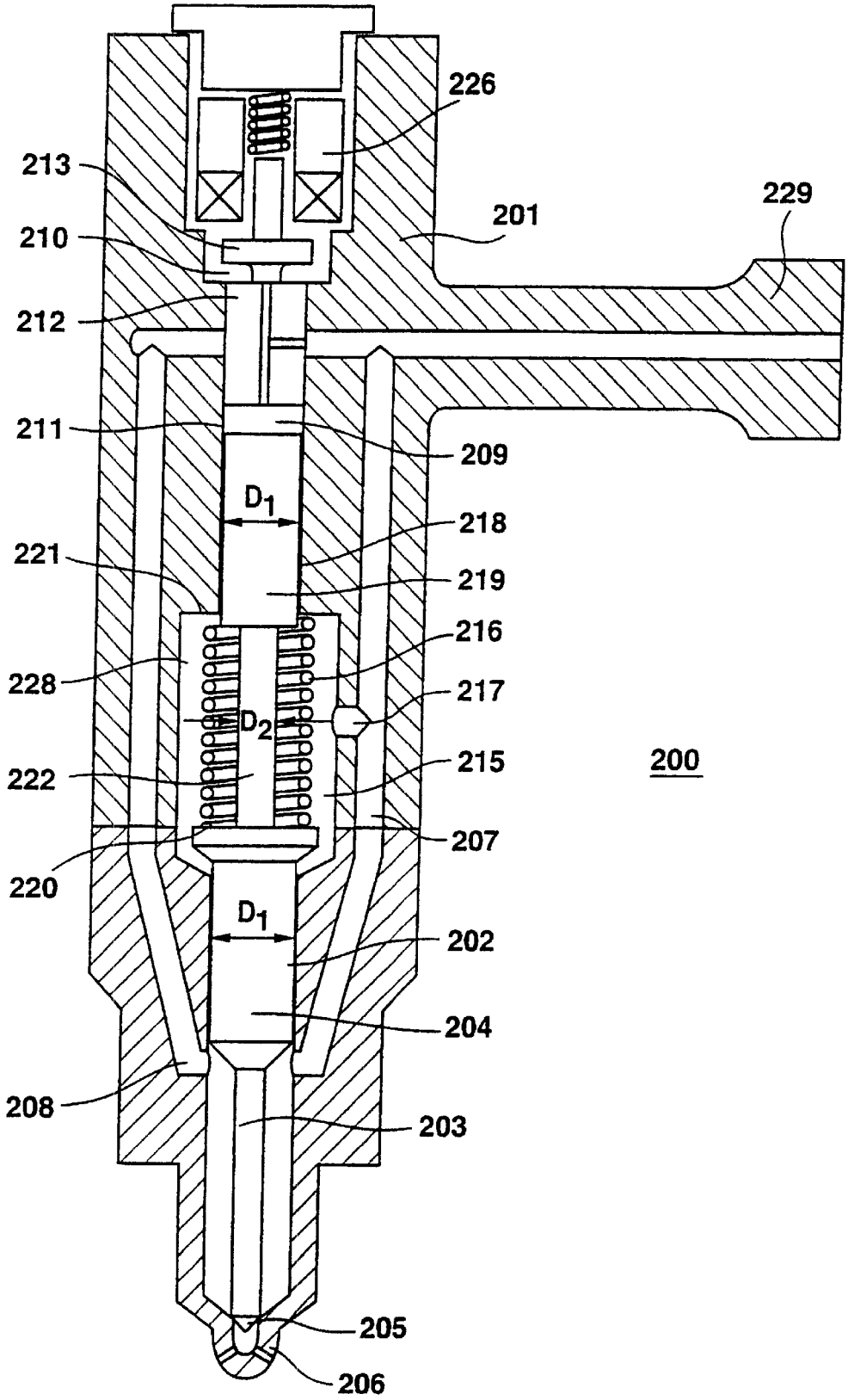
FIG. 2 a slightly schematic longitudinal sectional view of a fuel injector according to a second embodiment of the invention having a spring space and a restoring spring.

FIG. 2 illustrates a second embodiment of a fuel injector according to the invention for injecting highly pressurized fuel into the combustion space of an internal-combustion engine. The fuel injector, which as a whole has the reference number 200, comprises an injector housing 201, in which a nozzle needle 203 with a nozzle needle shaft 204 is longitudinally displaceably disposed in a first guide bore 202 constructed in the injector housing 201. The nozzle needle 203 has a nozzle needle point 205 which interacts in the sense of an opening and closing of a valve opening cross-section with a valve seat 206 constructed in the forward end of the injector housing 201, the valve opening cross-section being provided between the nozzle needle point 205 and the valve seat 206.

A high-pressure duct 207 is constructed in the injector housing 201 for feeding highly pressurized fuel to be injected and is connected with a pressure connection 229 to which the fuel to be injected is supplied by an oil-elastic pressure storage device (common rail), into which it is supplied by way of a high-pressure pump from a fuel supply (not shown).

On the front face of the first guide bore 202, a nozzle antechamber 208 is constructed in the injector housing 201, which nozzle antechamber 208 is acted upon at a high pressure by the fuel to be injected which is supplied by way of the high-pressure duct 207.

A control space 209, having a bore 211, is constructed in the rearward part of the injector housing 201 and by way of a throttle duct 214 connected with the high-pressure duct 207 is acted upon by highly pressurized fuel and can be relieved from pressure by way of a control valve 210.

On the rearward side of the first guide bore 202, a high-pressure space is provided between the nozzle needle 203 and the control space 209, which high-pressure space is formed by a spring space 215 containing the restoring spring 216 acting upon the nozzle needle 203 in the closing direction. The spring space 215 is separated from the control space 209 by a guiding piston 219 longitudinally displaceably disposed in a second guide bore 218 constructed coaxially to the first guide bore 202. The guiding piston 219 is coupled by way of a needle stilt 222 with the rear side of the nozzle needle 203, whereby a coupling of the control space 209 is established with the nozzle needle 203. The guiding piston 219 therefore bounds the spring space 215 on its rearward side. The spring space 215 is connected by way of a fluidic connection 217 with the high-pressure duct 207 carrying the fuel to be injected, so that the same high pressure exists in the interior of the spring space 215 as in the high-pressure duct 207 and therefore also in the nozzle antechamber 208. Thus, a flowing-over of fuel from the nozzle antechamber 208 by way of the first guide bore 202 into the space, specifically the spring space 215, situated on the rearward side of the nozzle needle 203 cannot take place.

Together with the force of the restoring spring 216, the fuel present in the spring space 215 at a high pressure acts upon the nozzle needle shaft 204 in the sense of a closing of the nozzle needle 203, while, when the control space 209 is relieved from pressure by way of the control valve 210, the nozzle needle 203 is relieved by the guiding piston 219 by way of the needle stilt 222 in the sense of an opening.

The control valve 210 contains a valve body 212 and a closing body 213 which, with respect to the operation, is coupled with a solenoid 226 controlling the operation of the fuel injector. The restoring spring 216 arranged in the spring space 215 is supported on one end by a first abutment 220 provided on the rearward side of the nozzle needle shaft 204 and is supported on the other end by a second abutment 221 constructed on the rearward side of the spring space 215.

The first guide bore 202 guiding the nozzle needle shaft 204 has a diameter D1. A third bore 228, which forms the spring space 215 and is coaxial to the first guide bore 202, has a diameter D2 which is larger than the diameter D1 of the first guide bore 202. The second guide bore 218, which is coaxial to the first guide bore 202 and therefore simultaneously to the third bore 228 forming the spring space 215 and which, in its rearward part also forms the control space 209, has a diameter D1' which, in the illustrated embodiment, is equal to the diameter D1 of the first guide bore 202; that is D1'=D1. The diameters D1, D1' and D2,—in the present embodiment, therefore only the two diameters D1 and D2—are mutually coordinated such that, during the opening and during the closing of the nozzle needle 203, the needle stilt 222 is stressed only with respect to tension. As a result, a buckling or a one-sided contacting of the needle stilt 222, which may lead to a jamming, is avoided.

The control space 209 has a significantly smaller volume than the spring space 215, whereby the response behavior of the fuel injector is improved.

What is claimed is:

1. A method of making a fuel injector for injecting high-pressure fuel into a combustion space of an internal combustion engine, comprising:

providing an injector housing, longitudinally displaceably disposing a nozzle needle shaft of a nozzle needle in a first guide bore of the injector housing, said nozzle needle including a nozzle needle point which operatively interacts with a valve seat in a forward end of the injector housing, providing a high-pressure duct for operatively supplying the high-pressure fuel to be injected, disposing a nozzle antechamber on a front face side of the first guide bore in front of the nozzle needle shaft, coupling a control space which is operatively acted upon by the high-pressure fuel with the nozzle needle, connecting a control valve to the control space so that the control valve can operatively release pressure from the control space, and arranging a space on a rearward side of the first guide bore so that said space operatively receives fuel flowing over from the nozzle antechamber via the first guide bore or the control space, wherein the space on the rearward side of the first guide bore is a high-pressure space operatively acted upon by the high-pressure fuel.

2. A method according to claim 1, wherein the high-pressure space on the rearward side of the first guide bore is formed by the control space.

3. A method according to claim 1, wherein the high-pressure space is formed by a spring space and is separate from the control space, said high-pressure space containing a restoring spring operatively acting upon the nozzle needle in a closing direction.

4. A method according to claim 1, wherein the injector housing contains at a rearward end an individual storage device, which is connected with the high-pressure duct guiding the fuel to be injected, for supplying highly pressurized fuel.

5. A method of operating a fuel injector for an internal combustion engine, comprising:

providing an injector housing an a nozzle needle which has a nozzle needle shaft longitudinally diplaceably disposed in a first guide bore in the injector housing and a nozzle needle point, supplying highly pressurized fuel to be injected via a high-pressure duct, applying the highly pressurized fuel to a nozzle antechamber disposed on a front face side of the first guide bore in front of the nozzle needle shaft, applying the highly pressurized fuel to a control space coupled with the nozzle needle, applying the highly pressurized fuel to a space arranged on a rearward side of the first guide bore, and relieving pressure in the control space via a control valve to thereby open the nozzle needle by unseating the nozzle needle point from a valve seat at a forward end of the injector housing, wherein said space receives fuel flowing over from the nozzle antechamber via the first guide bore or from the control space.

6. A fuel injector for injecting highly pressurized fuel into a combustion space of an internal combustion engine, comprising:

an injector housing, a nozzle needle which has a nozzle needle shaft longitudinally displaceably disposed in a first guide bore constructed in the injector housing and a nozzle needle point which interacts with a valve seat constructed in a forward end of the injector housing, a high-pressure duct for supplying the highly pressurized fuel to be injected, a nozzle antechamber disposed on a front face side of the first guide bore in front of the nozzle needle shaft and acted upon at high pressure by the fuel to be injected and supplied by way of the high-pressure duct, a control space which is coupled with the nozzle needle and acted upon by the highly pressurized fuel, said control space being relievable from pressure by way of a control valve which causes an opening of the nozzle needle, and a space arranged on a rearward side of the first guide bore, said space receiving fuel flowing over from the nozzle antechamber by way of the first guide bore or from the control space, wherein the space arranged on the rearward side of the first guide bore is a high-pressure space acted upon by the highly pressurized fuel.

7. A fuel injector according to claim 6, wherein the high-pressure space constructed on the rearward side of the first guide bore is formed by the control space.

8. A fuel injector according to claim 7, wherein the control space forming the rearward-side high-pressure space contains a restoring spring acting upon the nozzle needle in a closing direction.

9. A fuel injector according to claim 8, wherein the restoring spring is formed by a cup spring arrangement.

10. A fuel injector according to claim 9, wherein the restoring spring is supported on one end by a first abutment provided on a rearward side of the nozzle needle shaft and is supported on another end by a second abutment constructed on a rearward side of the control space.

11. A fuel injector according to claim 7, wherein the control space forming the rearward high-pressure space is formed by a control space bore extending in a longitudinal direction of the injector housing and, on a rearward side, is bounded by a valve body of the control valve inserted into said control space bore.

12. A fuel injector according to claim 8, wherein the control space forming the rearward high-pressure space is formed by a control space bore extending in a longitudinal direction of the injector housing and, on a rearward side, is bounded by a valve body of the control valve inserted into said control space bore.

13. A fuel injector according to claim 9, wherein the control space forming the rearward high-pressure space is formed by a control space bore extending in a longitudinal direction of the injector housing and, on a rearward side, is bounded by a valve body of the control valve inserted into said control space bore.

14. A fuel injector according to claim 10, wherein the control space forming the rearward high-pressure space is formed by a control space bore extending in a longitudinal direction of the injector housing and, on a rearward side, is bounded by a valve body of the control valve inserted into said control space bore.

15. A fuel injector according to claim 7, wherein the control space forming the rearward-side high-pressure space is connected by way of a throttle duct with the high-pressure duct guiding the fuel to be injected.

16. A fuel injector according to claim 8, wherein the control space forming the rearward-side high-pressure space is connected by way of a throttle duct with the high-pressure duct guiding the fuel to be injected.

17. A fuel injector according to claim 9, wherein the control space forming the rearward-side high-pressure space is connected by way of a throttle duct with the high-pressure duct guiding the fuel to be injected.

18. A fuel injector according to claim 10, wherein the control space forming the rearward-side high-pressure space is connected by way of a throttle duct with the high-pressure duct guiding the fuel to be injected.

19. A fuel injector according to claim 11, wherein the control space forming the rearward-side high-pressure space is connected by way of a throttle duct with the high-pressure duct guiding the fuel to be injected.

20. A fuel injector according to claim 6, wherein the rearward-side high-pressure space is formed by a spring space which is separate from the control space and contains a restoring spring acting upon the nozzle needle in a closing direction.

21. A fuel injector according to claim 20, wherein the spring space is connected by way of a fluidic connection with the high-pressure duct guiding the fuel to be injected.

22. A fuel injector according to claim 20, wherein a second guide bore is constructed on a rearward side of the spring space forming the high-pressure space, which said second guide bore extends coaxial to the first guide bore guiding the nozzle needle shaft, and in which said second guide bore, a guiding piston, which is coupled by way of a needle stilt with the nozzle needle, is longitudinally displaceably disposed, said guiding piston bounding the spring space on said rearward side.

23. A fuel injector according to claim 21, wherein a second guide bore is constructed on a rearward side of the spring space forming the high-pressure space, which said second guide bore extends coaxial to the first guide bore guiding the nozzle needle shaft, and in which said second guide bore, a guiding piston, which is coupled by way of a needle stilt with the nozzle needle, is longitudinally displaceably disposed, said guiding piston bounding the spring space on said rearward side.

24. A fuel injector according to claim 22, wherein the control space is constructed on a rearward side of the guiding piston, the fuel being situated at a high pressure in the spring space and the restoring spring acting upon the nozzle needle shaft in a sense of a closing of the nozzle needle, and wherein the nozzle needle, when the control space is relieved from pressure by way of the control valve, is relieved by the guiding piston by way of the needle stilt in a sense of an opening.

25. A fuel injector according to claim 24, wherein the first guide bore guiding the nozzle needle shaft has a diameter D1, the spring space is formed by a third bore coaxial to the first guide bore, a diameter D2 of the third bore being larger than the diameter D1 of the first guide bore, and the control space is formed by the second guide bore which is coaxial to the first guide bore and the spring space and has a diameter D1'.

26. A fuel injector according to claim 25, wherein the diameters D1, D1' and D2 are mutually coordinated such that the needle stilt is only stressed with respect to tension during the opening as well as during the closing of the nozzle needle.

27. A fuel injector according to claim 22, wherein the first guide bore and the second guide bore have the same diameter.

28. A fuel injector according to claim 24, wherein the first guide bore and the second guide bore have the same diameter.

29. A fuel injector according to claim 25, wherein the first guide bore and the second guide bore have the same diameter.

30. A fuel injector according to claim 26, wherein the first guide bore and the second guide bore have the same diameter.

31. A fuel injector according to claim 20, wherein the restoring spring is supported at one end by a first abutment provided on the rearward side of the nozzle needle shaft and is supported at the other end by a second abutment constructed on the rearward side of the spring space.

32. A fuel injector according to claim 22, wherein the restoring spring is supported at one end by a first abutment provided on the rearward side of the nozzle needle shaft and is supported at the other end by a second abutment constructed on the rearward side of the spring space.

33. A fuel injector according to claim 26, wherein the restoring spring is supported at one end by a first abutment provided on the rearward side of the nozzle needle shaft and is supported at the other end by a second abutment constructed on the rearward side of the spring space.

34. A fuel injector according to claim 27, wherein the restoring spring is supported at one end by a first abutment provided on the rearward side of the nozzle needle shaft and is supported at the other end by a second abutment constructed on the rearward side of the spring space.

35. A fuel injector according to claim 24, wherein the control space has a significantly smaller volume than the spring space.

36. A fuel injector according to claim 25, wherein the control space has a significantly smaller volume than the spring space.

37. A fuel injector according to claim 26, wherein the control space has a significantly smaller volume than the spring space.

38. A fuel injector according to claim 27, wherein the control space has a significantly smaller volume than the spring space.

39. A fuel injector according to claim 31, wherein the control space has a significantly smaller volume than the spring space.

40. A fuel injector according to claim 6, wherein the injector housing contains at a rearward end an individual storage device, which is connected with the high-pressure duct guiding the fuel to be injected, for supplying highly pressurized fuel.

41. A fuel injector according to claim 7, wherein the injector housing contains at a rearward end an individual storage device, which is connected with the high-pressure duct guiding the fuel to be injected, for supplying highly pressurized fuel.

42. A fuel injector according to claim 8, wherein the injector housing contains at a rearward end an individual storage device, which is connected with the high-pressure duct guiding the fuel to be injected, for supplying highly pressurized fuel.

43. A fuel injector according to claim 15, wherein the injector housing contains at a rearward end an individual storage device, which is connected with the high-pressure duct guiding the fuel to be injected, for supplying highly pressurized fuel.

44. A fuel injector according to claim 20, wherein the injector housing contains at a rearward end an individual storage device, which is connected with the high-pressure duct guiding the fuel to be injected, for supplying highly pressurized fuel.

45. A fuel injector according to claim 26, wherein the injector housing contains at a rearward end an individual storage device, which is connected with the high-pressure duct guiding the fuel to be injected, for supplying highly pressurized fuel.

* * * * *